US005474278A

United States Patent [19]

Cleveland

[11] Patent Number: 5,474,278

[45] Date of Patent: Dec. 12, 1995

[54] BACKPACK MOUNTED DEVICE FOR MOVING LOADS

[76] Inventor: Joe H. Cleveland, 304 College St., Ft. Valley, Ga. 31030

[21] Appl. No.: 812,428

[22] Filed: Dec. 23, 1991

[51] Int. Cl.[6] ..... B66D 3/26; A45F 3/08; B66C 1/10; F04B 17/00

[52] U.S. Cl. ..... 254/334; 254/358; 254/361; 224/153; 224/162; 294/115; 417/234

[58] Field of Search ..... 254/299, 346, 254/335, 336, 378, 358, 361; 24/598.5, 598.4, 598.1, 136 L, 136 R, 300; 26/2, 86, 87, 90; 224/153, 162, 158; 294/82.18, 82.32, 100, 115

[56] References Cited

U.S. PATENT DOCUMENTS

| | | | |
|---|---|---|---|
| 124,071 | 2/1872 | Lipsey | 24/537 |
| 227,793 | 5/1880 | Kingston | 24/598.5 |
| 249,177 | 11/1881 | Healey | 24/2.5 |
| 444,717 | 1/1891 | Stout | 24/598.5 |
| 1,148,704 | 8/1915 | Miller | 24/100 |
| 1,262,974 | 4/1918 | Pearen | 24/598.5 |
| 1,299,821 | 4/1919 | Carpmill et al. | 24/598.5 |
| 1,386,561 | 8/1921 | Foster | 24/82.27 |
| 1,684,322 | 9/1928 | Itjen | 24/598.5 |
| 1,787,150 | 12/1930 | Cerow et al. | 248/231 X |
| 2,028,701 | 1/1936 | Guier et al. | 254/323 |

(List continued on next page.)

FOREIGN PATENT DOCUMENTS

| | | | |
|---|---|---|---|
| 375902 | 1/1924 | Germany . | |
| 375901 | 1/1924 | Germany . | |
| 0593475 | 2/1934 | Germany | 417/234 |
| 526664 | 6/1957 | Italy . | |

OTHER PUBLICATIONS

Front and back covers and p. 6 of Thern. Inc. catalog.
Instruction manual for "Power Unit" of Jaws of Life® Rescue Systems.
Operating manual for "Helper™ Portable Winch".
Brochure for "Helper™ Winch Portable Pulling Power".
Brochure for "Helper Winch . . . a revolution in portable pulling power".
Brochure for "HELPER™ winch when outdoor recreation turns into work . . . ".
SUPERWINCH H9W Hydraulic Winch catalog sheet.
SUPERWINCH E10P catalog sheet.
SUPERWINCH H20P/H25P/H30P catalog sheet.
Brochure for the Multi–KBF–Cable Winch.
Brochure for the Hathaway Powered Winch.
SUPERWINCH X9 Electric Winch catalog sheet.
SUPERWINCH H8 catalog sheet.
SUPERWINCH HUSKY catalog sheet.
MY–TE Winch Hoists catalog.
SUPERWINCH AC 2000 Electric Winch catalog sheet.
SUPERWINCH X6 CD Electric Winch catalog sheet.

*Primary Examiner*—C. D. Crowder
*Assistant Examiner*—Ismael Izaguirre
*Attorney, Agent, or Firm*—Kilpatrick & Cody; John S. Pratt; Mitchell G. Stockwell

[57] ABSTRACT

A compact, light weight, back packable winch and power source, including a cable quick release device to facilitate single handed use of the winch. The power train and cable retrieval mechanisms are mounted on one side of a back pack frame or platform, and straps and padding enabling the mechanism to be carried like a back pack are mounted on the other side of the frame together with folding legs that assist in supporting the assembly during operation. A substantial quantity of small diameter cable is wound onto the winch spool by a level wind mechanism. The spool and level wind mechanism are powered, through chain and sprocket assemblies, by a hydraulic motor. The hydraulic motor is powered by a compact gasoline engine that operates a hydraulic pump to supply hydraulic fluid to the hydraulic motor, controlled by a flow control valve. The quick release utilizes pincers attached to the cable end and a shroud that holds the pincers closed around a chain link or loop and that may be slipped out of engagement with the pincers to permit them to open and release the load attached to the chain link or loop.

25 Claims, 4 Drawing Sheets

U.S. PATENT DOCUMENTS

| | | | |
|---|---|---|---|
| 2,122,340 | 6/1938 | Durno | 24/100 |
| 2,181,317 | 11/1939 | Fernstrom | 24/598.5 |
| 2,350,999 | 6/1944 | Beirise | 294/82.32 |
| 2,489,709 | 11/1949 | Hrabal | 24/598.5 |
| 2,634,155 | 4/1953 | Frieder et al. | 24/598.5 |
| 2,914,950 | 12/1959 | Giguere | 73/423.2 |
| 2,930,585 | 3/1960 | Reeves | 254/358 |
| 2,991,530 | 7/1961 | Johnson et al. | 24/598.5 |
| 3,037,579 | 6/1962 | Barrow | 182/187 X |
| 3,291,452 | 12/1966 | Rau et al. | 254/186 |
| 3,309,066 | 3/1967 | Carlson et al. | 254/334 X |
| 3,322,398 | 5/1967 | Smith | 254/335 X |
| 3,420,563 | 1/1969 | Witt | 294/16 |
| 3,429,374 | 2/1969 | Pridy | 254/323 X |
| 3,467,359 | 9/1969 | Durand | 254/168 |
| 3,531,066 | 9/1970 | Baekken | 294/82.32 |
| 3,739,728 | 6/1973 | Thompson | 254/323 X |
| 3,917,205 | 11/1975 | Meadors | 248/231 X |
| 3,952,382 | 4/1976 | Vaage | 24/598.5 |
| 3,973,754 | 8/1976 | Chadwick, Jr. | 254/323 |
| 4,054,256 | 10/1977 | Buck, Jr. et al. | 248/219.4 X |
| 4,145,028 | 3/1979 | Kelley et al. | 254/346 |
| 4,162,059 | 7/1979 | Fletchall | 254/187 |
| 4,168,793 | 9/1979 | Knight | 224/162 |
| 4,444,375 | 4/1984 | Horn | 254/346 |
| 4,452,478 | 6/1984 | Dulaney | 294/86.28 |
| 4,552,340 | 11/1985 | Sheppard | 254/358 |
| 4,588,167 | 5/1986 | Finzel | 254/346 |
| 4,623,124 | 11/1986 | Lewis | 254/361 X |
| 4,754,825 | 7/1988 | Scheffer | 180/7.5 |
| 4,938,400 | 7/1990 | Springton | 224/153 X |

BACKPACK MOUNTED DEVICE FOR MOVING LOADS

BACKGROUND OF THE INVENTION

This invention relates to winches and other devices useful in moving loads utilizing a cable.

The desire has existed since prehistoric times to transport objects heavier and more unwieldy than an individual can lift and carry. Efforts to answer this need also predate recorded history and were integral to the development of the earliest basic machines and tools, including levers, wheels, skids, rollers and utilization of animal power. While ancient humankind managed the movement of extraordinarily heavy objects, as demonstrated by the existence, for instance, of the Egyptian pyramids and Stonehenge, dramatic advances in this technology awaited development of combustion-based power sources, including steam and other external combustion engines and internal combustion engines. Later still, electrical motors came to the assistance of those interested in moving heavy objects.

A need persists, however, for a light weight, easily transported winch usable in locations remote from conventional power sources and vehicles, to move relatively heavy loads over relatively substantial distances, preferably with a single operator. Such a need exists, for instance, to retrieve large game from remote areas, in connection with rescue work, and in utilities installation and building construction. Numerous efforts have been undertaken to meet this need. For instance, one prior device, disclosed in U.S. Pat. No. 4,552,340, marries a chain saw engine to a winch mechanism. However, these efforts have not resulted in a device that is easily transported, accommodates substantial cable length, is safely operable by a single individual and exhibits other desirable features of the present invention.

SUMMARY OF THE INVENTION

The present invention provides a compact, backpackable winch and power source together with a cable quick release device that may be taken by an individual to a remote location, particularly, for instance, in wooded areas, and there operated single handed to move a heavy object over a substantial distance. The power train and cable retrieval mechanisms are mounted on one side of a platform or plate that serves as a backpack frame, and straps and padding enabling the mechanism to be carried like a backpack are mounted on the other side of the plate together with folding legs that assist in supporting the winch assembly during operation. A small diameter, high breaking strength cable is wound onto a spool utilizing a level wind mechanism. The spool and level wind mechanism are powered by a laminar flow hydraulic motor acting through a speed-reducing chain and sprocket assemblies to achieve desired rotational speeds. A compact internal combustion engine driving a pump provides hydraulic fluid that passes through a valve, the motor, a radiator-type heat removal system (or cooler), a filter, and a fluid reservoir. The hydraulic fluid valve allows the cable-wind mechanism to be quickly operated in either forward or reverse, or stopped as desired. An engine kill switch shuts the engine off when substantially all the cable has been wound onto the spool. A quick release mechanism on the remote end of the cable permits almost instantaneous disconnection of the cable from the load during operation, even under full load, thereby permitting an operator to position himself at the load in order to manage its movement, without concern about the possible need to release the connection to the load if that becomes necessary.

DETAILED DESCRIPTION OF THE DRAWINGS

Figures 1, 2:
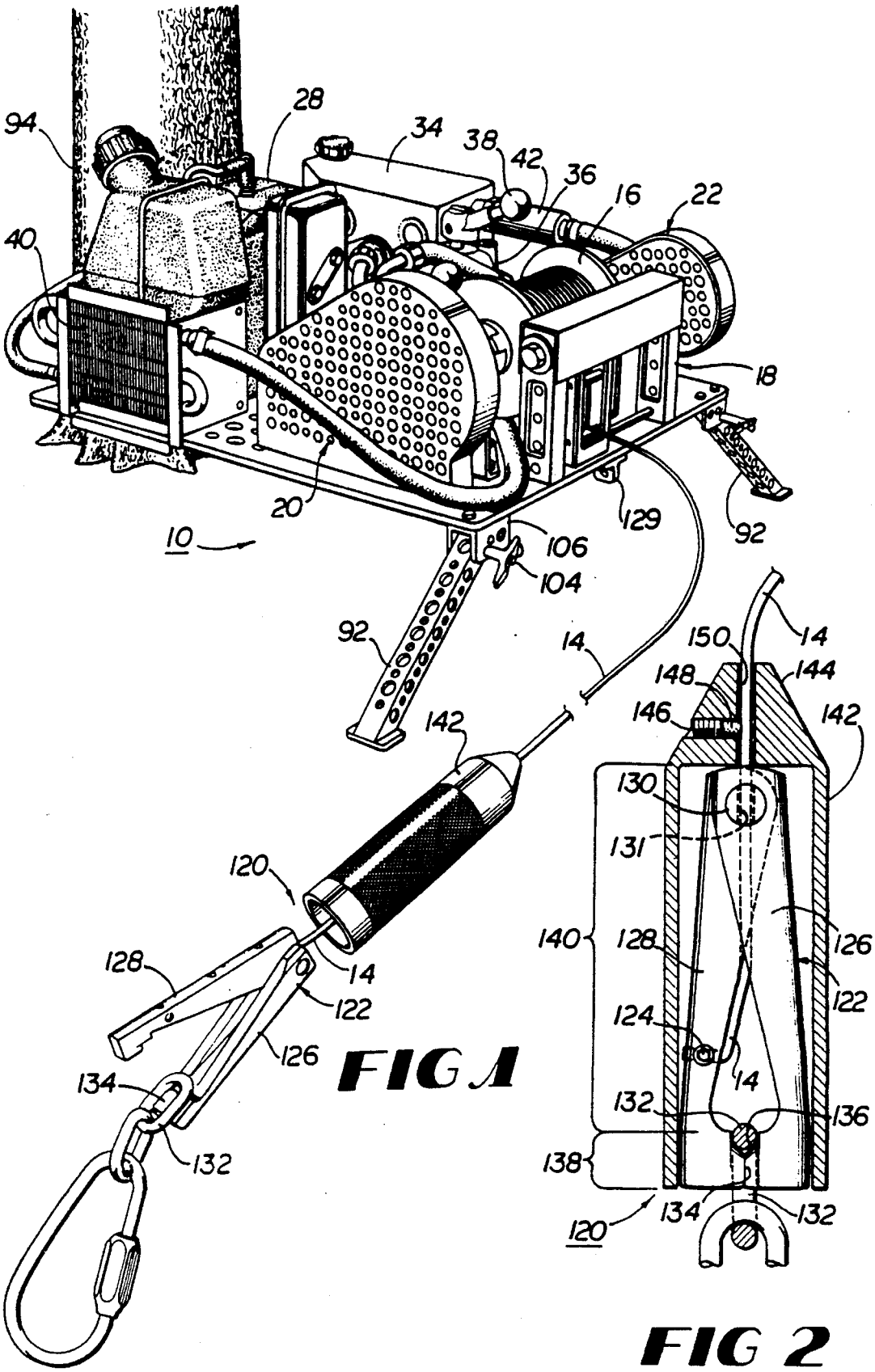
FIG. 1 is a perspective view of the backpackable winch of the present invention shown positioned for operation secured to a tree with the cable quick release mechanism of the present invention opened.
FIG. 2 is a side elevation view of the cable quick release mechanism shown in FIG. 1, with portions of the mechanism shown broken away to reveal internal structure.
Figure 4:
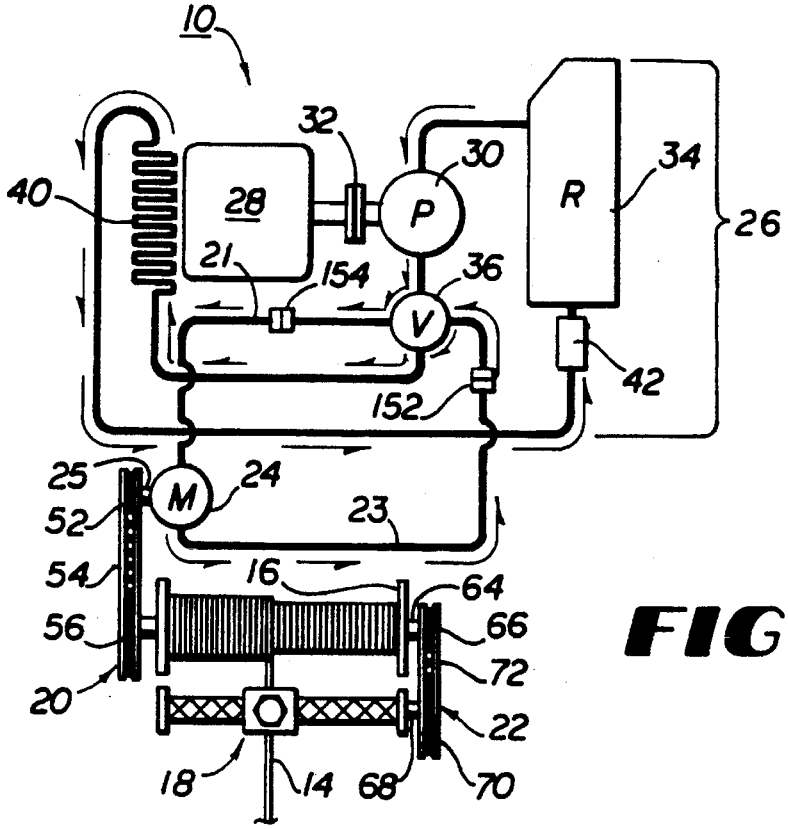
FIG. 4 is a simplified schematic view of the hydraulics, speed reduction and cable retrievable mechanisms of the winch of the present invention.
Figure 5:
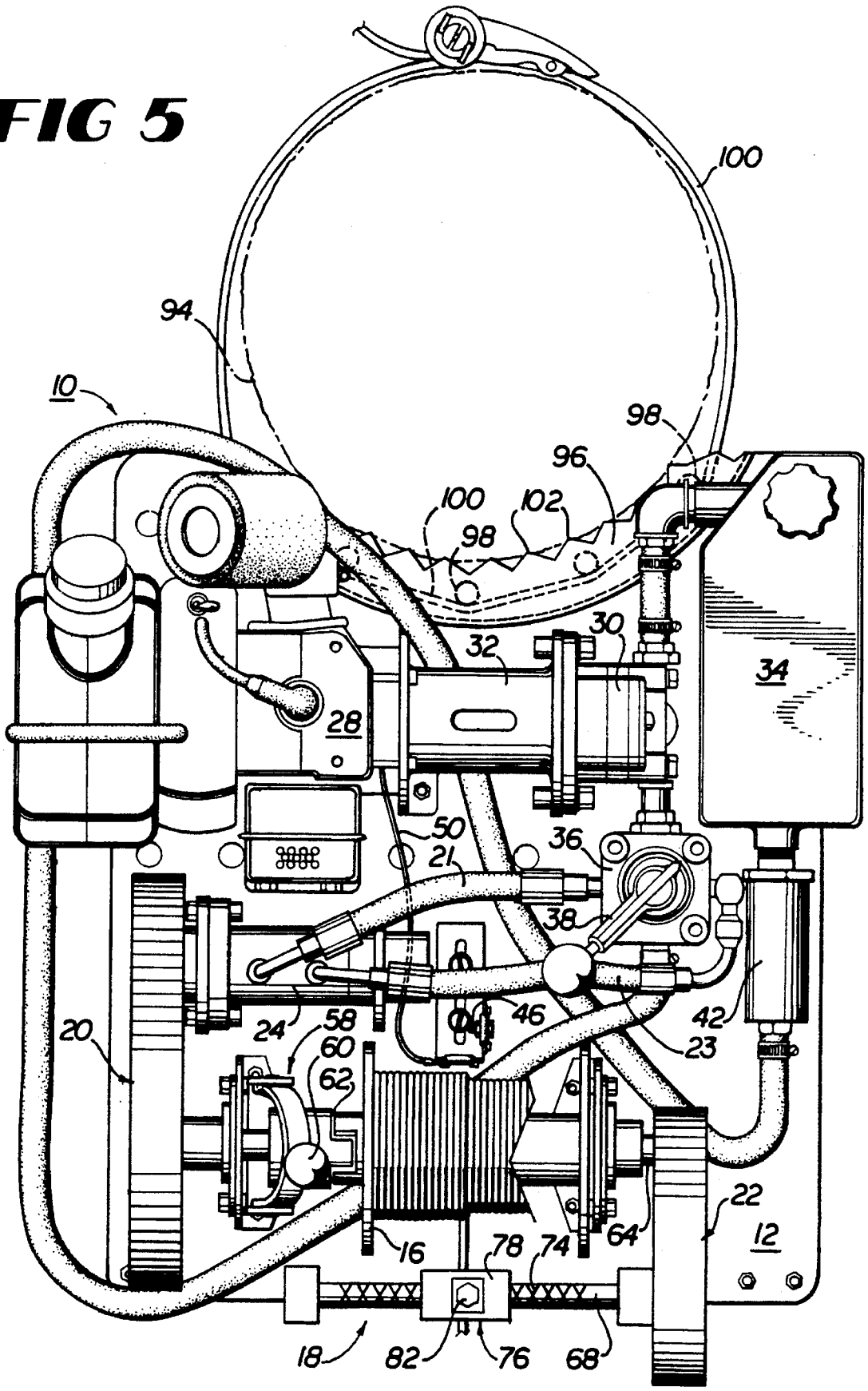
FIG. 5 is a top plan view of the winch of the present invention shown secured to a tree trunk that is illustrated in broken lines and with a portion of the cable shown broken away from the cable spool.

Referring to the figures, particularly including FIGS. 1, 4, and 5, the backpackable winch of the present invention comprises generally a platform or plate 12 that provides a frame on which substantially all of the components are mounted. A small diameter, high tensile strength cable 14 winds onto a spool 16. A substantial length of cable 14 is accommodated in a small space on spool 16 by the use of level-wind mechanism 18 that functions to guide cable 14 onto spool 16 in an orderly spiral that occupies the minimum space possible. Spool 16 and level-wind mechanism 18 are powered, through chain and sprocket drive trains 20 and 22, by a laminar flow hydraulic motor 24.

Hydraulic fluid flow is provided by a hydraulic power source 26 comprising a compact internal combustion engine 28 directly coupled to a hydraulic pump 30 through a "love joy" or other appropriate coupling mechanism 32. Hydraulic fluid contained in fluid reservoir 34 flows, as is illustrated in FIG. 4, through pump 30 and then through valve 36 operable by rotation of valve control lever 38 to choose a "neutral," "cable in" or "cable out" position. With valve 38 in the "cable in" position, hydraulic fluid is caused to flow through the motor 24 as indicated by the arrows in FIG. 4 and thereby rotate its shaft 25. Fluid flows from the motor again through valve 36, to the cooler 40 mounted in the illustrated embodiment so that airflow through the engine 28 draws air through cooler 40. From the cooler 40, fluid flows through filter 42 and then back into fluid reservoir 34. Air can, of course, be moved through cooler 40 in a variety of alternative ways, such as by driving a fan off of the driver shaft of engine 28 or motor 24, among other means.

Figure 7:
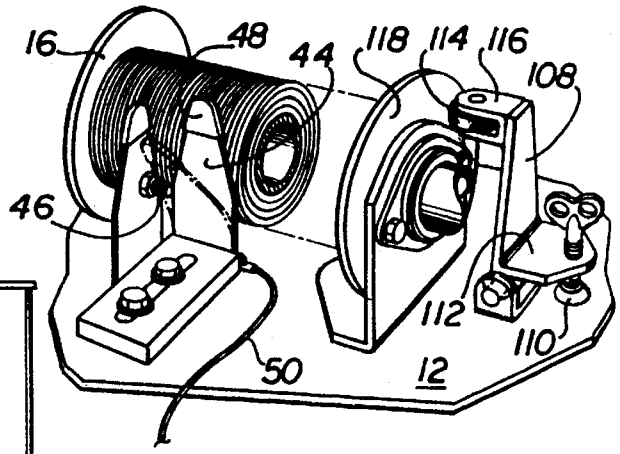
FIG. 7 is a perspective view of the cable spool of the winch of the present invention illustrating the automatic shut off mechanism and an optional mechanical brake.

As is best illustrated in FIGS. 5 and 7, an automatic kill switch may be provided utilizing a spring metal switch contact 44 shown in solid lines in FIG. 7 in contact with cable 14 on spool 16. Contact 44 is shown in broken lines in FIG. 7 in an alternative inoperable position in which it is retained behind a stud 46 that holds it out of contact with cable 14, regardless of the quantity of cable 14 on spool 16.

Manipulation of contact 44 may be accomplished utilizing a plastic, non-conductive cover 48 on the exposed end of contact 44. Kill switch contact 44 is mounted so that it is insulated from electrical contact with plate 12 and all other components of the winch 10 but is electrically connected with an insulated wire 50 to the ignition system of engine 28. Thus, contact between kill switch contact 44 and cable 14 electrically connects the ignition system of engine 28 to "ground" through other metal components of the winch, thereby disabling the ignition system and stopping engine 28. Contact 44 may be suitably positioned, when used, so that cable 14 on spool 16 touches contact 44 when a predetermined quantity of cable 14 has wound onto spool 16.

An "anti-reverse" mechanism may be added to spool 16 utilizing, for instance, a conventional rachet and pawl mechanism to insure, if desired, that spool 16 cannot reverse direction in response to tension applied to cable 14.

Level Wind Mechanism

The level wind mechanism 18 and associated drive trains 20 and 22 of the present invention are powered, as explained above, by hydraulic motor 24 that rotates, during typical operation, at approximately 350 revolutions per minute (rpm). A motor sprocket 50 mounted on motor 24, may have twelve teeth and drive, through spool chain 54, a spool sprocket 56 having seventy-two or more teeth, so that spool 16 rotates at 58.3 rpm or less when motor 24 rotates at 350 rpm.

A mechanically operable coupling mechanism 58, controllable by manipulating coupling knob 60 from side to side to engage or disengage a lovejoy or other coupling 62 permits spool 16 to free-wheel when coupling 58 is disengaged.

On the remote end of spool shaft 64 (see FIGS. 4 and 5), a twelve tooth level-wind drive sprocket 66 is mounted. Level-wind shaft 68 parallels spool shaft 64 and carries on one end, aligned with the level wind drive sprocket 66, a thirty-six tooth level-wind shaft sprocket 70. Level-wind chain 72 couples level-wind sprocket 66 and 70 so that level-wind shaft 68 always rotates when spool 16 rotates at a relative speed that ensures (in light of the cable 14 diameter, sprocket 66 and 70 sizes and the pitch of level-wind spiral grooves 74) that a level-wind traveler 76 will traverse back and forth in front of spool 16 at a rate that results in cable 14 being laid on spool 16 in a uniform, tight spiral. Traveler 76 may be a bearing carrier 78 that traverses back and forth on carrier rods 80 journaled in parallel bores in the carrier 78, controlled by a follower (not visible) positioned under follower cap 82, which follower engages spiral groove 74 in level wind shaft 68.

Horizontal bearings 71 and 73 are positioned in bearing carrier 78 to bracket the minimum and maximum positions of cable winding onto spool 16 when the spool is empty and full, respectively, or, in the case of lower bearing 73, to facilitate cable 14 travel when the load is well below the plane of plate 12. Vertical bearings 75 and 77 are spaced just wider than the diameter of cable 14, and thus closely control cable 14 as it feeds onto spool 16. For instance, bearings 75 and 77 may typically be spaced 3/16 inch (or twice the cable diameter) apart for 3/32 inch cable, but adjustment may be necessary to optimize loading of cable 14 on spool 16. All of bearings 71, 73, 75 and 77 may be rotatable rollers or smooth rods of metal or other suitable, low friction material.

Alternative level wind mechanisms and alternative elements of the level wind mechanism illustrated and described in detail can also be used. For instance, traveler 76 could be moved back and forth in front of spool 16 utilizing a hydraulically actuated piston. Significantly different spool and cable handling configurations may also be desirable. For example, quick cable removal capability may be desirable in some applications by orienting the axis of the cable spool in line with the direction the cable is drawn off so that it can be stripped off the spool end like fishing line on a spinning reel.

Cable

Spiral groove 74 has a pitch of 3.5 to 1 for use with the above described sprockets and cable 14 that is three thirty-seconds of an inch (3/32") in diameter.

Alternatively, cable 14 one-eight inch in diameter may be utilized if the relative speeds of spool shaft 64 and level-wind shaft 68 are altered by using sprockets 66 and 72 having twelve and twenty-seven teeth, respectively. Cable 14 may be steel "aircraft" cable, but a variety of other cables having sufficient tensile strength, suitably small diameter to accommodate the desired length of cable on spool 16 and the necessary flexibility to wind onto spool 16 may also be used. While nonconductive cable may be desirable in certain applications, use of nonconductive cable 14 will require appropriate modifications of the above-described kill switch, since the described embodiment relies on electrical contact between contact 44 and electrically conductive cable 14.

Back Pack Structure

Figure 3:
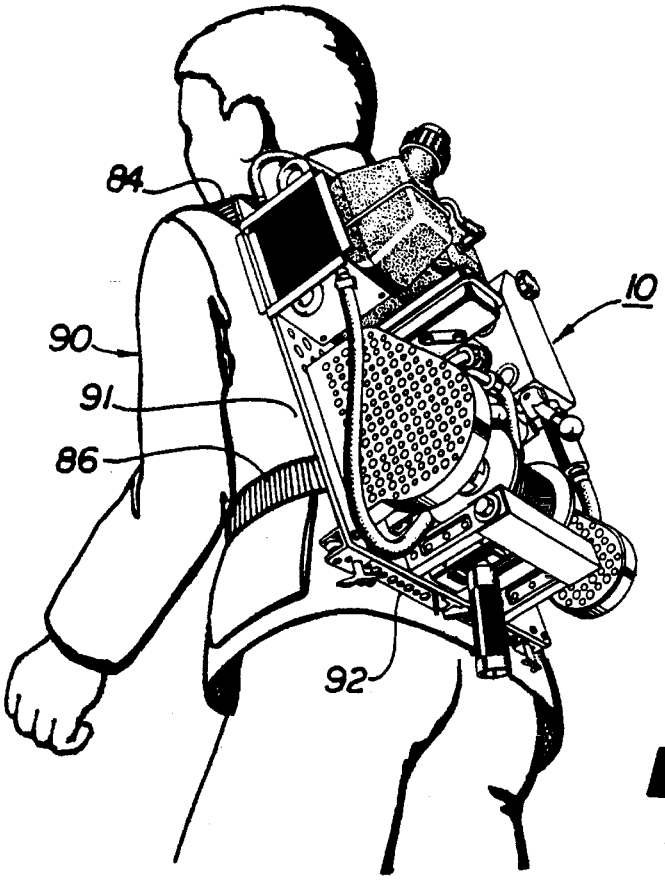
FIG. 3 is a perspective view of the winch of present invention being carried on the back of a user.
Figure 6:
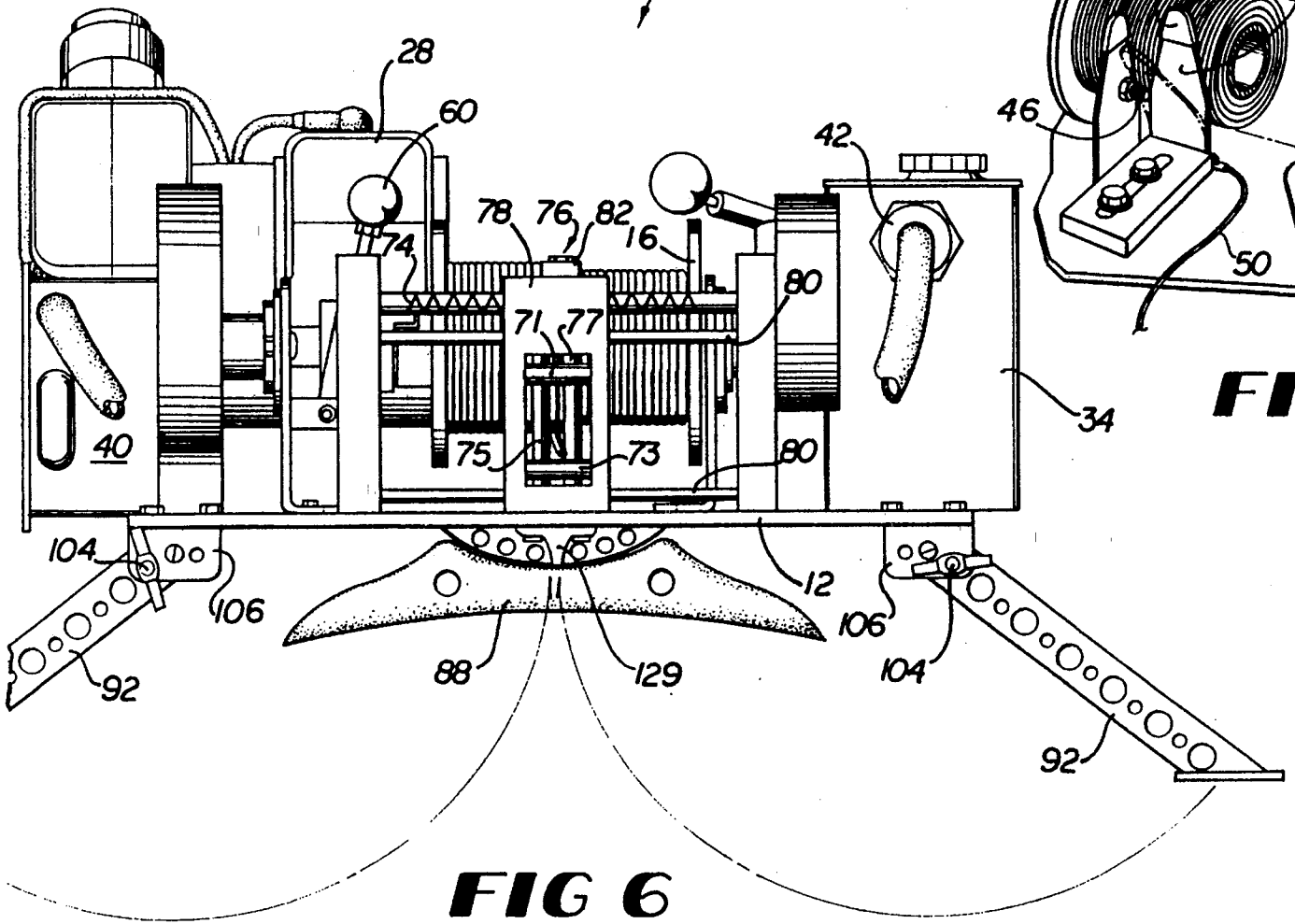
FIG. 6 is a front elevation view of the winch of the present invention with portions of the hydraulic lines broken away for clarity.

As is illustrated in FIG. 3, shoulder straps 84 and a waist band 86 allow the winch 10 to be transported on user's back 91. Appropriately contoured padding 88, as illustrated in FIG. 6 (similar, for instance, to such structures used with scuba diving tanks or hiking backpack frames) is attached to the underside of plate 12 to permit winch 10 to lie comfortably against the back of user's 90.

Securing Structures

Winch 10 may be positioned for use in a variety of ways. Most typically, winch 10 will be positioned horizontally on the ground (as illustrated in FIG. 1) resting on and stabilized by splayed legs 92 and supported and secured to a tree trunk or post 94 (shown in broken lines in FIG. 5). In order to secure the winch 10 to such a generally circular trunk 94, plate 12 is machined to have a semicircular saw tooth shape on the edge opposite the level wind mechanism, and a semicircular, like-shaped saw toothed plate 96 (visible in FIG. 5) is rigidly attached parallel to plate 12 and spaced above it an appropriate distance on the order, for example, of one and one-half inches, with spacers such as round studs 98 shown in broken lines in FIG. 5. As will readily be appreciated by one of ordinary skill in the art, a securing strap 100 may then pass behind studs 98 and encircle trunk 94 to draw trunk engaging teeth 102 of the plates 12 and 96 against the trunk 94. Legs 92, shown in their folded position in FIG. 3 and extended position in FIG. 6, are lockable in each of their folded and extended positions with pins 104 that engage appropriately spaced holes in the brackets 106 within which legs 92 pivot. In their splayed, open position, legs 92 extend below and well outboard of plate 12 to provide stable support for winch 10 in cooperation with the above-described attachment to trunk 94.

Brake

A variety of hydraulic and mechanical mechanisms may be utilized if it is desired to permit spool 16 to rotate in a controlled fashion. One such optional mechanical brake is illustrated in FIG. 7. A Z-shaped bracket 108 is pivotally attached to plate 12. Rotation of a threaded foot 110 mounted on the lower arm 112 of bracket 108 pivots bracket 108 to force a rubber wheel 114 or other appropriate bearing device mounted on arm 116 against one end 118 of spool 16, thereby frictionally inhibiting rotation of spool 16 in proportion to the pressure applied through foot 110 and accordance with the other characteristics of the mechanical brake.

Quick Release

A quick release 120, illustrated in FIGS. 1 and 2, is critical to safe, single handed operation of the transportable winch 10 of the present invention under certain circumstances and may be used in a wide variety of other applications where releasable connection to a cable or other line is desired.

Release 120 comprises pivoting pincers 122 to which cable 14 is connected to pincers 122 with a lock screw 124 illustrated in FIG. 2. Additional lock screws, not shown, may also be employed to ensure fail-safe connection of cable 14 to pincers 122. Pincers 22 comprise two arms 128 that pivot on a shaft 130. Cable 14 passes through a hole 131 in shaft 130 and then to the point it is secured by screw 124, so that the cable does not obstruct the operation of pincers 122. Alternatively, cable 14 may be secured to shaft 130 by swedging it in hole 131 or other appropriate means. Arms 126 and 128 close against each other like pliers around a chain link 132, with abutting surfaces 134 that meet inside the link 132 and adjacent sloping surfaces 136 that together form a V-shaped cradle within which link 132 rests. Because surfaces 136 slope, there is no tendency for link 132 to catch on either of arms 126 or 128 when the arms open. This feature of quick release 120 could be further refined, particularly in quick release 120 units intended for very heavy duty applications. For instance, rotatable bearings could be substituted for surfaces 136 to further facilitate smooth release of link 132 from pincers 122.

When closed to grasp link 134, pincers 122 have a cylindrical section 138 and a tapered section 140. Pincers 122 are held closed to grasp link 134 by a tubular cover or shroud 142 that preferably has a conical end 144 pieced by a cable tunnel 150 that is coaxial with shroud 142 and through which cable 14 passes freely. An optional means for fixing shroud 142 on cable 14 or controlling passage of cable 14 through shroud 142 may be provided by a set screw 146 threaded into the conical end of shroud 142 and acting against a plug 148 that in turn bears against cable 14 in response to rotation of set screw 146.

As will be readily appreciated by reference to FIGS. 1 and 2, quick release mechanism 120 normally functions with cable 14 able to pass freely through passage 150 in the conical end 144 of shroud 142. With shroud 142 fully covering pincers 122, arms 126 and 128 are maintained firmly closed around link 132, and loads attached to link 132 are pulled by cable 14 with the conical end of shroud 142 facilitating the avoidance of snags. Cable 14 may be quickly disconnected from link 132, and thus from the load, by firmly grasping shroud 142 and sliding it along cable 14 away from link 132. Straight section 138 may include roller bearings or other friction-reducing means to facilitate movement of shroud 142. Once shroud 142 has advanced beyond the straight section 138 of pincers 122, their tapered shapes, and the tendency the application of load to link 132 acting against V-shaped surfaces 136 to cause pincers 122 to open, actually facilitates further movement of shroud 142 and opening of pincers 122, thereby immediately disconnecting the winch 10 from the load.

As FIGS. 1 and 2 also illustrate, the conical shape of end 144 of shroud 142 presents a sloping surface to obstructions as quick release 120 advances toward winch 10 as cable 14 is retrieved. This permits quick release to pass over obstructions like rocks, protruding roots and brush with little risk of catching on such obstructions.

Winch Operation

It will typically be desirable to secure winch 10 to a tree trunk or a post as describe above, so that winch 10 remains stationary while a load is drawn toward the winch, or the load is permitted, operating spool 16 in reverse, to move away from the winch under powered control. However, other modes of operation are possible. For instance, it may be desirable under certain circumstances to secure the winch to the load to be moved and the remote end of cable 14 to an anchor or other fixed object. Then the winch 10 may be operated to draw both it and the load toward the anchor as cable is accumulated on spool 16. As will be readily appreciated, handles, skids or wheels, among other alternatives, may desirably be mounted on winch 10 to facilitate such alternative operation.

Winch 10 may also be secured to anchor points or loads in a variety of alternative manners. For instances, coaxial holes bored through saw-tooth plate 96 and plate 12 (FIG. 5) may receive studs or bolts secured to a truck bed or a vehicle bumper so that the winch 10 is securely mounded on such a mobile platform and is thus usable as a vehicle-mounted winch.

For heavier loads, it may be desirable to utilize a block and tackle arrangement (not shown). For instance, cable 14 might pass through a block-attached to the load, with the end of cable 14 attached to hitch 129 (FIG. 1).

Alternative Embodiments

Substantial additional flexibility utilizing the present invention and numerous additional applications for elements of it can be achieved by recognition that it provides (1) a hydraulically powered winch mechanism that can utilize a separate source of hydraulic fluid and (2) a hydraulic power mechanism that can be utilized to power other hydraulic devices. This flexibility can be achieved, for instance, by utilization of conventional quick connect and disconnect hydraulic fittings 152 and 154 (FIG. 4) in the hydraulic lines 21 and 23 attached to motor. With such fittings 152 and 154 in place, the engine 28, pump 30, reservoir 34, valve 36 and the associated components can be used as a hydraulic power module to power a wide variety of other hydraulically actuated equipment, particularly including mechanisms such as impact wrenches, pruners and saws widely utilized by utility maintenance crews and parks departments.

Similarly focusing on the valve 36, hydraulic motor 24 and spool 16 and level wind mechanism 18, alternative, commercially available hydraulic power sources can be utilized to power the cable 14 handling structures of the present invention, which can then be used as one of several devices usable with such existing hydraulic power units such as the "jaws of life" system.

Furthermore, alternative embodiments of the present invention can be configured using other engines, such as external combustion engines or (battery or commercial alternating current) electric motors. Other embodiments may also utilize alternatives to the hydraulics described in detail above, such as entirely mechanical coupling, through an appropriate transmission, between (1) the engine 28 and (2) spool 16 and level wind 18.

Alternative means may also be used to control the winch 10, including remote control apparatus. For instance, both the engine 28 and valve 38 can be remotely controlled by conventional radio apparatus utilizing a suitable transmitter, receiver, servos and other control apparatus coupled to the engine 28 and valve 38 controls. The winch 10 operator could then use a hand-held transmitter to control engine speed (or to stop the engine) and to operate the valve 36 to cause spool 16 to retrieve or dispense cable or stop, as desired. Suitable radio control apparatus is widely used, for instance, in radio controlled model airplanes and remote-controlled garage door operators.

As will also be appreciated by one of ordinary skill in the art, the embodiments of the present invention described above in detail are intended to be merely illustrative of the various combinations of components and arrangements of components that can be utilized to obtain the described objectives of the invention without departing from the intended scope or spirit of the foregoing description, the associated drawings and the following claims.

I claim:

1. A portable winch, comprising a cable retrieval mechanism mounted on a backpack frame, supporting legs attached to the backpack frame and means for securing the backpack frame to a fixed object during use of the winch.

2. A portable winch, comprising a cable retrieval mechanism mounted on a backpack frame and means for securing the frame to a fixed object during use of the winch comprising a generally arcuate portion of the frame and a securing strap for encircling the object and drawing the generally arcuate portion of the frame into contact with the object.

3. The portable winch of claim 2, further comprising legs attached to the frame.

4. A portable winch comprising, a cable retrieval mechanism mounted on a backpack frame defining an arcuate portion, means for securing the arcuate portion of the backpack frame to a fixed object during use of the winch, and legs attached to the frame and movable between a folded position for transporting the winch and an unfolded position for using the winch.

5. A portable winch, comprising a cable retrieval mechanism mounted on a backpack frame, legs attached to the frame and means for securing the frame to a fixed object during use of the winch comprising a generally arcuate portion of the frame and a securing strap for encircling the object and drawing the generally arcuate portion of the frame into contact with the object.

6. A portable winch, comprising a cable retrieval mechanism mounted on a backpack frame, legs attached to the frame and movable between a folded position for transporting the winch and a splayed position for using the winch, and a means for securing the frame to a fixed object during use of the winch comprising a generally arcuate portion of the frame and a securing strap for encircling the object and drawing the generally arcuate portion of the frame into contact with the object.

7. A portable hydraulic power source, comprising an engine coupled to a hydraulic pump mounted on a backpack frame, legs attached to the frame and movable between a folded position for transporting the power source and a splayed position for using the power source, and a means for securing the frame to a fixed object during use of the power source comprising a generally arcuate portion of the frame and a securing strap for encircling the object and drawing the generally arcuate portion of the frame into contact with the object.

8. A portable winch for moving loads over substantial distances utilizing an anchor, comprising:

(a) a backpack frame and means for attaching the frame to the anchor, (b) at least one carrying strap attached to the frame, (c) mounted for transportation and operation on the frame, a cable retrieval mechanism, and (d) a cable having two ends, one of which is attached to the cable retrieval mechanism and the other of which is free for attachment to a load remote from the anchor.

9. A portable winch for moving loads over substantial distances utilizing an anchor, comprising:

(a) a backpack frame and means for attaching the backpack frame to the anchor, (b) at least one carrying strap attached to the frame, (c) mounted for transportation and operation on the frame:
(i) a cable retrieval mechanism and
(ii) a powered means for operating the cable retrieval mechanism, and (d) a cable having two ends, one of which is attached to the cable retrieval mechanism and the other of which is free for attachment to a load remote from the anchor.

10. A portable hydraulic power source, comprising (a) a backpack frame, (b) legs attached to the backpack frame and adjustable in height to conform with variable terrain for supporting the backpack frame in a stable position during operation of the hydraulic power source, (c) a gasoline powered engine coupled to (d) a hydraulic pump fluidically coupled to (e) a reservoir for hydraulic fluid and a flow control valve, and (f) means for fluidically coupling the pump to a hydraulic fluid powered device.

11. A portable winch, comprising:

(a) a backpack frame, (b) folding and adjustable legs attached to the backpack frame for supporting the backpack frame upon uneven terrain, (c) means for securing the backpack frame to a fixed object, (d) a gasoline powered engine coupled to (e) a hydraulic pump fluidically coupled to (f) a hydraulic motor mechanically coupled to (g) a rotatable cable spool to which cable is attached and (h) a level-wind mechanism for guiding the cable onto the spool.

12. The winch of claim 11, further comprising a flow control valve for controlling the direction of flow of hydraulic fluid through the hydraulic motor and wherein the means for securing comprises a generally arcuate portion of the frame having at least one sawtooth edge for engaging the object and a securing strap for encircling the object and drawing the generally arcuate portion of the frame into contact with the object and wherein the folding and adjustable legs are movable between a lockable, folded position for transporting the winch and a lockable, splayed position with the legs oriented at approximately ninety degrees relative to each other for using the winch.

13. The winch of claim 11, further comprising a means for disabling the engine when the spool has accumulated a predetermined quantity of cable.

14. The winch of claim 11, further comprising:

pincers attached to the cable, the pincers:

(i) comprising two generally L-shaped arms, each having a shroud-contacting surface and terminating in a jaw having an abutting surface and an adjacent sloping surface and each arm pivoted on a common axis to open so that the abutting surfaces are separated or close so that the abutting surfaces are in contact, (ii) being selectively closable to grasp a loop by encircling a portion of the loop as the abutting surfaces of the pincers meet inside the loop and the adjacent sloping surfaces of the pincers together form an acute V-shaped cradle to receive a portion of the loop and (iii) having first longitudinal opposed surfaces of the L-shaped arms that are parallel when the arms are closed and second longitudinal opposed portions of the arms that converge when the arms are closed, (b) a shroud positionable to slide on the cable to a position encircling the pincers and thereby holding them closed or other positions clear of the pincers that permit the pincers to open and release the loop.

15. The winch of claim 11, wherein the level-wind mechanism comprises a traveler for traversing back and forth in front of the cable spool.

16. A portable winch, comprising:

(a) a backpack frame, (b) legs attached to the backpack frame and movable between a folded position for transporting the winch and a splayed position for using the winch, (c) means for securing the backpack frame to a fixed object, (d) a hydraulic pump fluidically coupled to (e) a hydraulic motor mechanically coupled to (f) a rotatable cable spool to which cable is attached and (g) a level-wind mechanism for guiding the cable onto the spool.

17. A portable winch, comprising:

(a) a backpack frame, (b) means for securing the frame to a fixed object comprising a generally arcuate portion of the frame and a securing strap for encircling the object and drawing the generally arcuate portion of the frame into contact with the object and, mounted on the frame for transportation and operation of the winch:

(c) a motor coupled to (d) a rotatable cable spool to which cable is attached, and (e) a level wind mechanism for guiding cable onto the spool.

18. The portable winch of claim 17, wherein the motor is a fluidic motor.

19. A portable winch, comprising (a) a frame, (b) legs attached to the frame, movable between a folded position for transporting the winch and a splayed position for using the winch, (c) means for securing the frame to a fixed object, (d) a hydraulic motor mechanically coupled to (e) a rotatable cable spool to which cable is attached, (f) a level-wind mechanism for guiding cable onto the spool, and (g) means for disabling the motor when the spool has accumulated a predetermined quantity of cable.

20. The portable winch of claim 19, wherein the means for securing the frame to a fixed object comprises a generally arcuate portion of the frame and a securing strap for encircling the object and drawing the generally arcuate portion of the frame into contact with the object.

21. A portable winch, comprising:

(a) a backpack frame, (b) at least one carrying strap attached to the frame, (c) mounted for transportation and operation on the frame:

(i) a cable retrieval mechanism and (ii) a powered means for operating the cable retrieval mechanism, (d) legs attached to the frame and movable between a folded position for transporting the winch and a splayed position for using the winch, and (e) means for securing the frame to a fixed object during use of the winch comprising a generally arcuate portion of the frame and a securing strap for encircling the object and drawing the generally arcuate portion of the frame into contact with the object.

22. A portable winch, comprising:

(a) a frame and legs attached to the frame and moveable between a folded position for transporting the winch and an unfolded position for using the winch, (b) means for securing the frame to a fixed object comprising a generally arcuate portion of the frame and a securing strap for encircling the object and drawing the generally arcuate portion of the frame into connect with the object and, mounted on the frame for transportation and operation of the winch;

(c) a pump fluidically coupled to;

(d) a fluidic motor mechanically coupled to;

(e) a rotatable cable spool to which cable is attached, and (f) a traveler coupled to traverse back and forth in front of the cable spool in synchronism with the rotation of the cable spool for guiding cable onto the spool.

23. A portable winch, comprising (a) a backpack frame, (b) folding legs attached to the frame, (c) a means for securing the frame to a fixed object, (d) a gasoline powered engine coupled to (e) a hydraulic pump fluidically coupled to (f) a hydraulic motor mechanically coupled to (g) a rotatable cable spool mounted for operation on the frame and to which cable is attached, (h) a level-wind mechanism for guiding cable onto the spool, and (i) attached to the cable, a quick release comprising:

(1) pincers for connection to a cable that may close to grasp a loop attached to a load and (2) a shroud journaled to slide on the cable to a position encircling the pincers and thereby holding them closed or in other positions clear of the pincers that permit the pincers to open and release the loop.

24. A portable winch, comprising:

(a) a backpack frame, (b) at least one carrying strap attached to the frame, (c) mounted for transportation and operation on the frame:

(i) a cable retrieval mechanism and (ii) a powered means for operating the cable retrieval mechanism, (d) a quick release mechanism for attachment to a load, wherein the quick release mechanism comprises:

(1) pincers attached to the cable, the pincers having abutting surfaces and adjacent sloping surfaces and being selectively closeable to grasp a loop by encircling a portion of the loop as the abutting surfaces of the pincers meet inside the loop and the adjacent sloping surfaces of the pincers together form an acute V-shaped cradle to receive a portion of the loop, and (2) a shroud positionable to slide on the cable to a position encircling and substantially covering the pincers and thereby holding them closed or other positions clear of the pincers that permit the pincers to open and release the loop, and (e) a cable attached at one end to the cable retrieval mechanism and to the quick release mechanism at the other end.

25. A portable winch, comprising:

(a) a backpack frame, (b) at least one carrying strap attached to the frame, (c) mounted for transportation and operation on the frame:

(i) a cable retrieval mechanism and (ii) a powered means for operating the cable retrieval mechanism, (d) a quick release mechanism for attachment to a load, wherein the quick release mechanism comprises:

(x) pincers attached to the cable, the pincers:

(i) comprising two generally L-shaped arms, each having a shroud-contacting surface and terminating in a jaw having an abutting surface and an adjacent sloping surface and each arm pivoted on a common axis to open so that the abutting surfaces are separated or close so that the abutting surfaces are in contact, (ii) being selectively closable to grasp a loop by encircling a portion of the loop as the abutting surfaces of the pincers meet inside the loop and the adjacent sloping surfaces of the pincers together form an acute V-shaped cradle to receive a portion of the loop and (iii) having first longitudinal opposed surfaces of the L-shaped arms that are parallel when the arms are closed and second longitudinal opposed portions of the arms that converge when the arms are closed, and (y) a shroud positionable to slide on the cable to a position encircling the pincers and thereby holding them closed or other positions clear of the pincers that permit the pincers to open and release the loop, and (e) a cable attached at one end to the cable retrieval mechanism and to the quick release mechanism at the other end.

* * * * *